US007291028B2

(12) United States Patent
Hall et al.

(10) Patent No.: US 7,291,028 B2
(45) Date of Patent: Nov. 6, 2007

(54) ACTUATED ELECTRIC CONNECTION

(76) Inventors: David R. Hall, 2185 S. Larsen Pkwy., Provo, UT (US) 84606; Joe Fox, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 11/174,702

(22) Filed: Jul. 5, 2005

(65) Prior Publication Data

US 2007/0010119 A1 Jan. 11, 2007

(51) Int. Cl.
*H01R 4/60* (2006.01)

(52) U.S. Cl. ..... 439/194; 439/192

(58) Field of Classification Search ..... 439/310, 439/190–195

See application file for complete search history.

(56) References Cited

U.S. PATENT DOCUMENTS 3,976,347 A * 8/1976 Cooke et al. ..... 439/132
4,039,237 A * 8/1977 Cullen et al. ..... 439/191
4,660,910 A * 4/1987 Sharp et al. ..... 439/194
4,799,544 A * 1/1989 Curlett ..... 166/65.1
4,859,196 A * 8/1989 Durando et al. ..... 439/197
4,997,384 A * 3/1991 Godfrey et al. ..... 439/190
6,223,826 B1 * 5/2001 Chau et al. ..... 166/380
6,717,501 B2 * 4/2004 Hall et al. ..... 336/132
6,945,802 B2 * 9/2005 Hall et al. ..... 439/194
7,114,970 B2 * 10/2006 Head ..... 439/191

* cited by examiner

*Primary Examiner*—James Harvey
*Assistant Examiner*—X. Chung-Trans
(74) *Attorney, Agent, or Firm*—Tyson J. Wilde

(57) ABSTRACT

A downhole connection in a tool string has a first transmission path in a first tubular component and a second transmission path in a second tubular component coaxial with the first tubular component. The first transmission path has an electrically conductive pin attached to an actuator disposed within the first tubular component. The second transmission path has an electrically conducting receptacle disposed within the second tubular component. When the pin and the receptacle are proximate one another and the actuator is energized, the pin is inserted into the receptacle to form an electrical connection between the first and second transmission paths. The actuator may include a solenoid, a piezoelectric material, a magnetostrictive material, a piston, a fluid, an electrically controllable fluid, a gear, a pivot, a bearing, a spring or combinations thereof.

15 Claims, 18 Drawing Sheets

ACTUATED ELECTRIC CONNECTION

BACKGROUND OF THE INVENTION

The present invention is related to downhole communication, more specifically to downhole communication utilizing direct electrical connections. The oil and gas industries have utilized several methods to communicate between the surface and downhole tools. Recently, IntelliServ Inc. developed a communication system disclosed in U.S. Pat. No. 6,670,880 to Hall, et al.; which in herein incorporated by reference for all that it discloses; for use in a downhole tool string. The '880 patent discloses magnetic communication between downhole tool string components. Other systems utilize electrical contacts, such as U.S. Pat. No. 6,688,396 to Floerke, which is herein incorporated by reference for all that it discloses.

Other patent references in the prior art include U.S. Pat. No. 6,394,837 to Edwards et al., which is herein incorporated by reference for all that it discloses. The '837 patent discloses an electrical connector system for providing an electrical connection through the wellhead into a tubular element with apertures for carrying electrical cables downhole. The system includes a circumferential electrical conductor ring which is coupled to, and insulated from, a tubular subsea element such as a tubing hanger surrounding the conductor ring. The conductor ring is coupled to an electrical connector of a horizontally mounted electrical connector assembly which is hydraulically actuated to penetrate the elastomeric element in the direction transverse to the longitudinal axis of the tubular element to make electrical contact with the conductor ring.

U.S. Pat. No. 6,433,991 to Deaton, et al. is also herein incorporated by reference for all that it discloses. The '991 patent discloses an actuator assembly including an operating actuator and a holding actuator that are engagable with an operating member of a device. The operating actuation is cycled between on and off states to move the operating member in incremental steps, and the holding actuator is maintained in an active state to maintain or latch the current position of the operator member. Each of the operating and holding actuators may include one of the following: a solenoid actuator, and an actuator including one or more expandable elements, such as a piezoelectric element, a magnetostrictive element, and a heat-expandable element.

U.S. Pat. No. 6,200,152 to Hopper is herein incorporated by reference for all that it discloses. The '152 patent discloses an electrical connection across a peripheral surface through a seal enclosure in a radial plane between a tubing hanger and a surrounding support member. The connection includes a coupling element in the tubing hanger and an electrical contact supporting shuttle which can reciprocate from a position wholly within the support member, across the interface and into electrical connection with the coupling element without producing any movement in a conductor cable leading into a seal enclosure within the support.

U.S. Pat. No. 5,749,608 is also herein incorporated by reference for all that it discloses. The '608 patent discloses a lateral connector for a tube assembly having a modular unit which can be used to establish a lateral connection through the sidewall of a tubular member positioned around it. The modular unit has a carrier ring, a coupling element, and carrier body. The coupling element can move radially, but not axially. The carrier ring has generally cylindrical inside and outside surfaces. The coupling element is carried by the carrier ring. The coupling element has a longitudinal axis which is generally radially positioned with respect to the longitudinal axis of the carrier ring. The coupling element has an inner end and an outer end and the outer end has a sealing face.

U.S. Pat. No. 5,174,765 is herein incorporated by reference for all that it discloses. The '765 patent discloses a connector including a first connector member that is connected to a first conductor and includes a probe that is inserted through an insulating elastomer into a conductive elastomer which is connected to a second conductor and located in a second connector member. The connection between the probe and the conductive elastomer provide a noise free electrical connection between the two conductors.

U.S. Pat. No. 4,589,492 is herein incorporated by reference for all that it discloses. The '492 patent discloses a submersible pump installation for a subsea well with an electrical connection that is hydraulically made up with provisions to avoid contact with sea water. The submersible pump is suspended by a suspension head located in a tubular member at the subsea wellhead. An electrical connector pin is carried in the insulator. A piston moves the insulator into contact with the suspension head, then the connector pin into engagement with the electrical connector located in the suspension head.

BRIEF SUMMARY OF THE INVENTION

A downhole connection in a tool string has a first transmission path in a first tubular component and a second transmission path in a second tubular component coaxial with the first tubular component. The first transmission path has an electrically conductive pin slideably attached to an actuator disposed within the first tubular component. The second transmission path has an electrically conducting receptacle disposed within the second coaxial tubular component. The pin and electrically conducting receptacle form an electrical connection when they are proximate another and the actuator is energized.

The actuator may include a solenoid, a piezoelectric material, a magnetostrictive material, a piston, a fluid, an electrically controllable fluid, a gear, a pivot, a bearing, a spring or combinations thereof. The actuator may control the linear position of the pin thereby breaking or forming the direct electrical connection. The actuator may also include multiple power consumption states. The pin may travel linearly within a passage when acted upon by the actuator. It may be advantageous for the passage to include at least one wiper, as the wiper may prevent downhole fluid or debris from collecting on the pin and interfering with forming a direct electrical connection.

The electrically conductive receptacle may be an annular trough, thereby allowing the direct electrical connection to be formed at any annular position that the pin may be disposed within the first tubular component. In other aspects of the present invention, the annular trough may be segmented. The segments of the trough may be electrically isolated from each other thereby allowing additional transmission paths to form electrical connections without interfering with each other. The annular troughs may comprise sides that are biased inward which may help form the electrical connection. Further the biased sides may help clean the pin as it enters the receptacle. Additionally, the receptacle may comprise other wipers as well. The receptacle may also be biased upward towards the first tubular component. This may be advantageous for forming the electrical connection. The direct electrical connection may be maintained by a force provided by the actuator. The first transmission path may provide the electrical energy to the actuator.

When the first and second tubular components are joined at the ends, the ends may form a mechanical seal which protects the direct electrical connection. The mechanical seal may protect the connection from a harsh downhole condition, drilling mud, debris or combinations thereof. The groove may be formed within the primary shoulder face, secondary shoulder face, tertiary shoulder face, or internal wall of the end of the second tubular component. The transmission paths may comprise a coaxial cable, a pair of twisted wires, a triaxial cable, a twinaxial cable, copper wires, or combinations thereof. There may be additional transmissions path in either the first or second tubular components. The additional transmission paths may also comprise a direct electrical connection formed between an electrically conductive pin and an electrically conducting receptacle. In other aspects of the invention, the additional transmission paths may comprise inductive couplers, optic couplers, acoustic couplers, or other direct electrical connections. The transmission paths may comprise a switch. A switch may be advantageous so that the transmission paths may be able to communicate with each other. The transmission paths may be capable of relaying power, data, network packets, or combinations thereof between surface equipment and downhole tools. The tubular components may be selected from the group consisting of production pipe, drill pipe, drill collars, motors, reamers, subs, swivels, jars, hammers, and bottom hole assemblies.

DETAILED DESCRIPTION OF THE INVENTION AND THE PREFERRED EMBODIMENT

Figure 1:
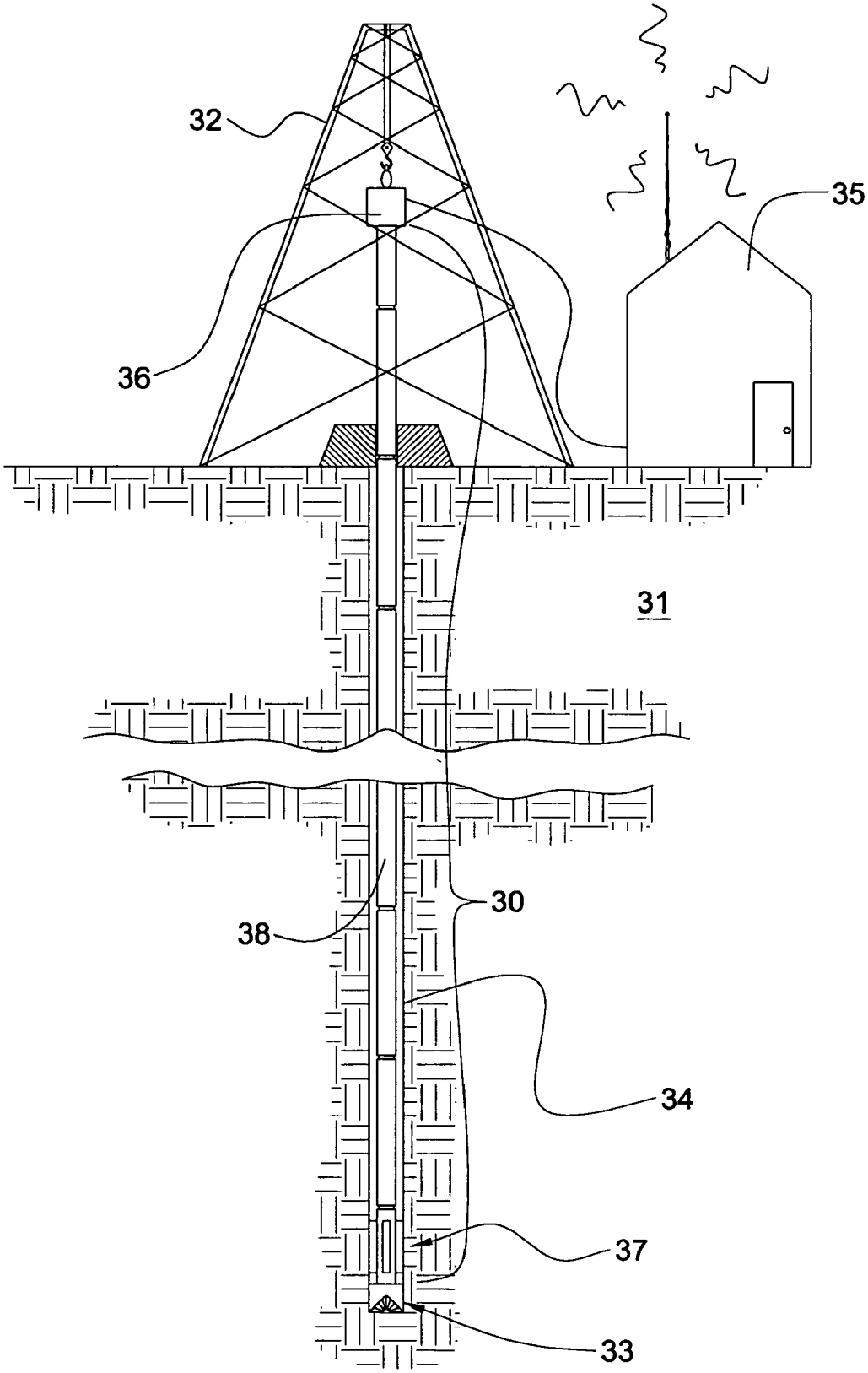
FIG. 1 is a perspective diagram of a drill string suspended within the earth.

FIG. 1 is a perspective diagram of a downhole tool string 30 suspended in the earth 31. A derrick 32 supports the tool string 30. The tool string 30 may be made up of a plurality of tubular components. The tubular components may be production pipe, drill pipe 38, drill collars, motors, reamers, subs, swivels, jars, hammers, or bottom hole assemblies 37. Downhole tools, such as those located near the bottom 33 of the bore hole 34, may communicate with surface equipment 35. A swivel connection 36 may transmit data, power, network packets, or combinations thereof between the tool string 30 and the surface equipment 35.

Figure 2:
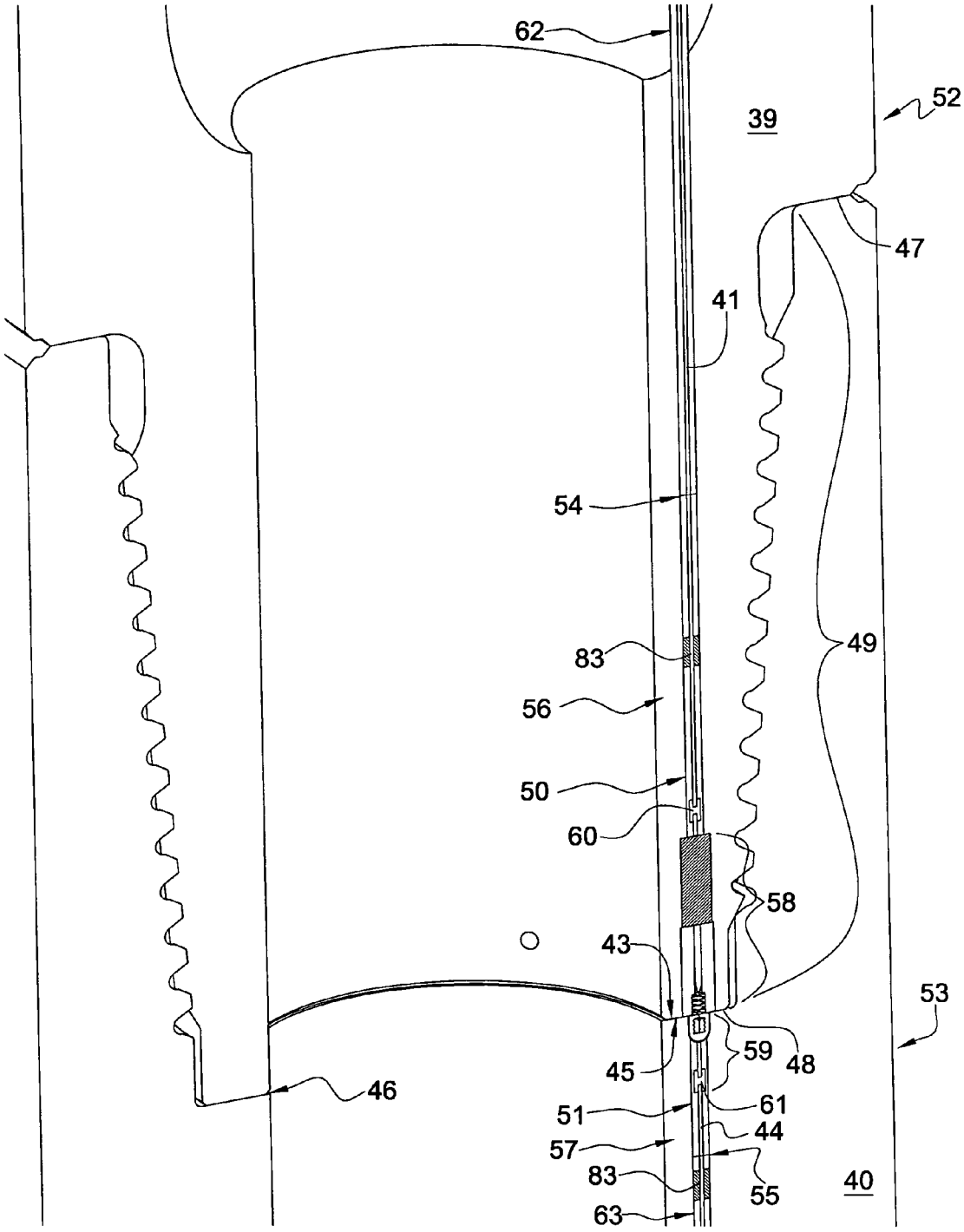
FIG. 2 is a perspective cross sectional diagram of a first and second tubular component.

FIG. 2 is a perspective cross sectional diagram of a first and second tubular component 39, 40. A plurality of transmission paths may run between the surface equipment 35 and the downhole tools. A first transmission path 41 terminates at the end 43 of the first tubular component 39 and a second transmission path 44 terminates at the end 45 of the second tubular component 40. The transmission paths 41, 44 may comprise coaxial cables, pairs of twisted wires, triaxial cables, twinaxial cables, copper wires, or combinations thereof. When the ends 43, 45 of the first and second tubular components are torqued together the ends 43, 45 may form a mechanical seal 46 and the transmission paths 41, 44 may align with each other at the end 43, 45 of the tubular components 39, 40. The transmission paths 41, 44 may align with each other in the primary shoulder face 47, secondary shoulder face 48, or internal wall 49 of the end 45 of the second tubular component 40. If the components 39, 40 comprise a tertiary shoulder (not shown), the transmission paths 41, 44 may align within a tertiary shoulder face.

Each transmission path 41, 44 may be retained within each tubular component 39, 40 by milling a passage 50, 51 within an upset portion 52, 53 of the components 39, 40 and anchoring the paths 41, 44 within the passages 50, 51. The passages 50, 51 may comprise a larger diameter 54, 55 near the ends 43, 45 of the components 39, 40 and a ferrule 83 may be wedged within the passages 50, 51 to anchor portions 56, 57 of the transmission paths 41, 44 in place. While stretching the transmission paths 41, 44 to the opposite end (not shown) of the tubular components 39, 40, a similar passage on the opposite end of the tubular components 39, 40 may allow the other end of the transmission paths 41, 44 to be anchored in place.

Each end of each paths 41, 44 may comprise a replaceable portion 58, 59 that may be inserted into the passages 50, 51 formed in the tubular components 39, 40. Electrically conducting connectors 60, 61 may allow the replaceable portion 58, 59, when inserted within the passages 50, 51, to make direct electrical contact with the stretched portions 62, 63 of the transmission paths 41, 44.

Figure 3:
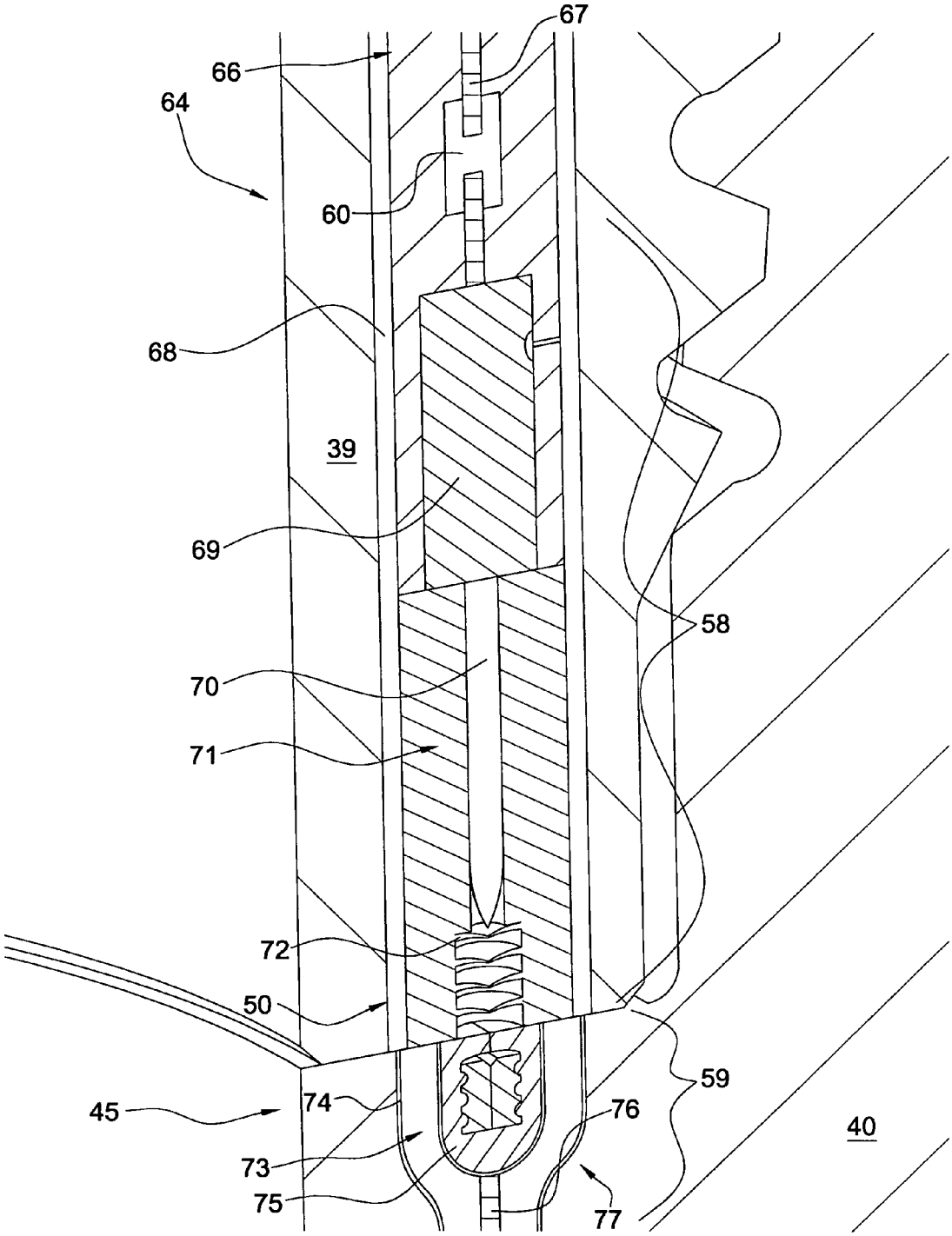
FIG. 3 is a cross sectional diagram of an electrically conducting pin in a retracted position.
Figure 4:
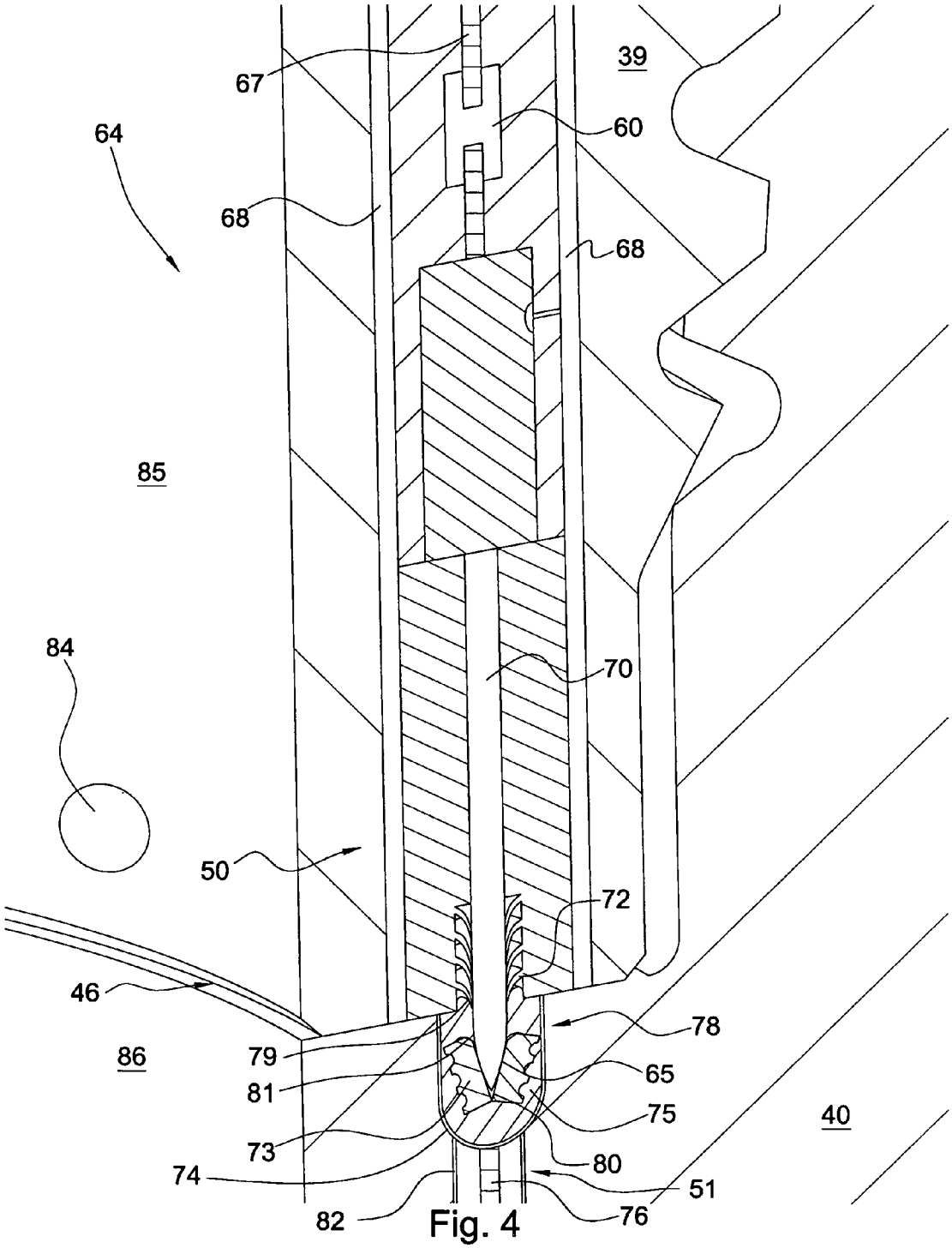
FIG. 4 is a cross sectional diagram of a direct electrical connection.

FIG. 3 is a cross sectional diagram of an electrically conducting pin 70 in a retracted position 71. The first transmission path 41 comprises a coaxial cable 66. The replaceable portions 58, 59 are in electrical contact with the inner core 67 of the coaxial cable 66. An electrically conducting connector 60 connects the inner core 67 with replaceable portion 58 and is also electrically insulated from the outer shield 68 of the coaxial cable 66, which is grounded to the tubular component 39. In the end of the first component 39 an actuator 69 is also in electrical communication with the inner core 67 of the coaxial cable 66 and electrically insulated from the outer shield 68. An electrically conducting pin 70 is slideably attached to the actuator 69 and the position of the pin 70 is controlled by the actuator 69. Elastomeric material 72 protects the pin 70 from lubricants and other debris from entering the passage 50 where the pin 70 resides. In the end 45 of the second component 40, an electrically conducting receptacle 73 is disposed within a groove 74 formed in the second tubular component 40. The receptacle 73 is also electrically insulated from the tubular component 40, by an elastomeric lining 75. A lining may also comprise a ceramic, plastic or other electrically insulating material. The elastomeric lining 75 may also bias the sides of the receptacle 73 inward to help make an electrical connection 65 with the pin 70 (as shown in FIG. 4). The receptacle 73 is also in electrical communication with the inner core 76 of the coaxial cable 77 of the second tubular component 40.

FIG. 4 is a cross sectional diagram of a direct electrical connection 65. The pin 70 is shown in a contacting position 78. The elastomeric material 72 of the first component 39 acts as a wiper as the pin 70 travels from the retracted position 71 (shown in FIG. 3) to the contacting position 78. The elastomeric material 72 may help form a secondary seal 79 with the receptacle 73 to further protect the electrically conducting pin 70. It is important that the pin 70 be clean enough to make electrical contact with the receptacle 73. As the pin 70 enters the receptacle 73, the sides 80 of the receptacle 73 may further wipe the sides 81 of the pin 70. Preferably, the pin 70; receptacle 73; inner cores 67, 76; outer shield 68, 82; electrical connectors 60, 61; and other components of the downhole connection 64 comprise a corrosion resistant coating (not shown). The corrosion resistant coating may comprise a material selected from the group consisting of nickel, phosphorous, cobalt, tungsten, gold, silver, chromium, and aluminum.

The elastomeric lining 75 may bias the receptacle 73 towards the first component 39 as the pin 70 pushes the receptacle 73 away from the first component 39. This may be advantageous to help form a contact 65 between the receptacle 73 and the pin 70. Other forms of biasing mechanisms may be used to help bias the receptacle 73. U.S. patent application Ser. Nos. 10/430,734; 10/453,076; and 10/612,255 disclose several biasing mechanisms that may work with the present invention. U.S. patent application Ser. Nos. 10/430,734; 10/453,076; and 10/612,255 are all herein incorporated by reference for all that they disclose. Further, when the tubular components 39, 40 are torqued together and form a mechanical seal 46, lubricants or debris may be caught within the groove 74 or passage 50, 51. In some embodiments a venting pathway 84 may be formed between the groove 74 and the bore 86 of the second tubular component 40 or between the passage 50 and the bore 85 of the first tubular component 39. A venting pathway that may be compatible with the present invention is described in U.S. application Ser. No. 10/708,793, which is herein incorporated by reference for all that it discloses.

Figure 5:
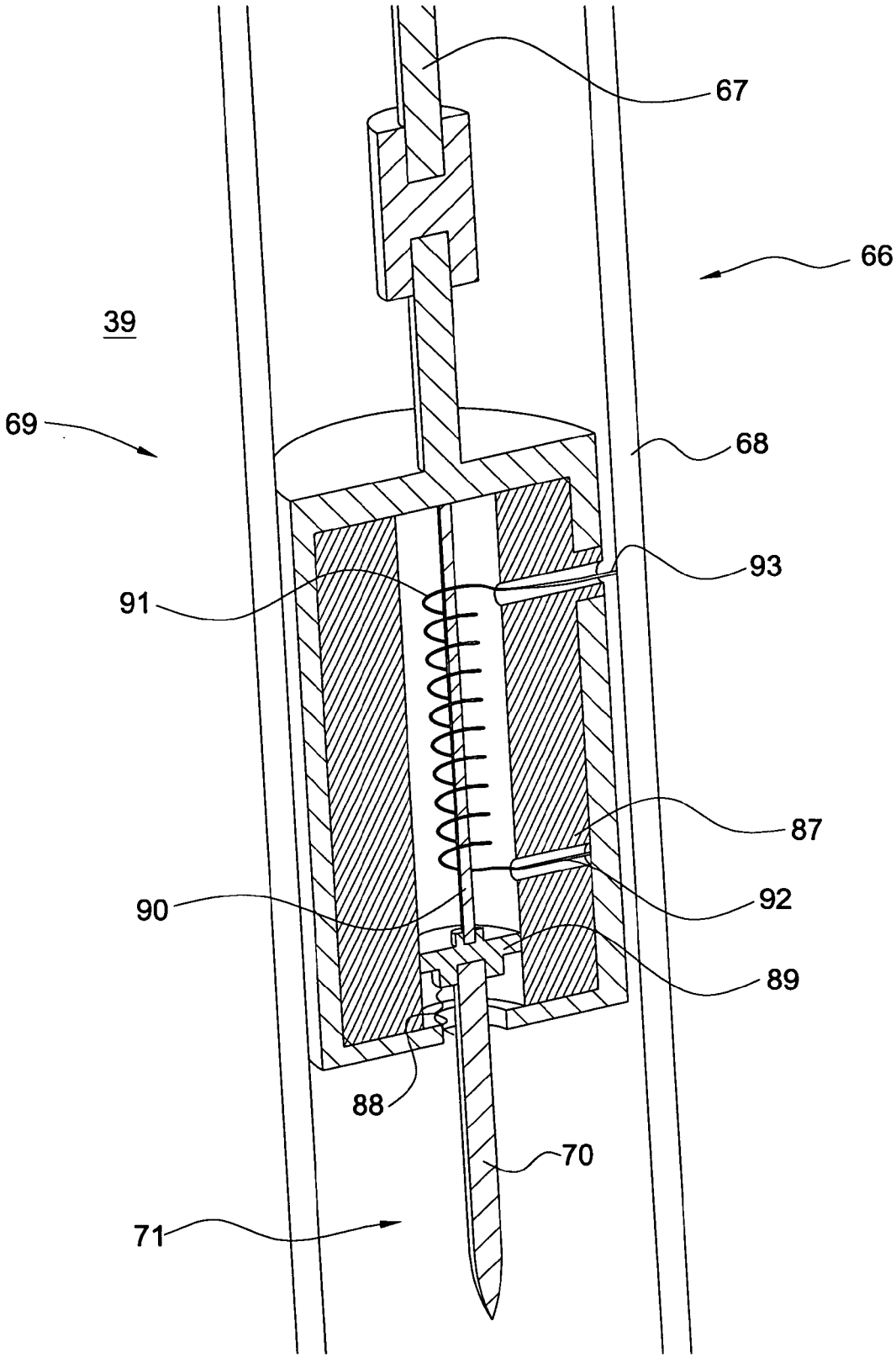
FIG. 5 is a cross sectional diagram of an actuator.

FIG. 5 is a cross sectional diagram of an actuator 69. The actuator 69 comprises an electrically conducting body 87 in electrical communication with the inner core 67 of the coaxial cable 66 of the first tubular component 39. The electrically conducting body 87 is electrically insulated from the outer shield 68 of the coaxial cable 66. When the pin 70 is in the retracted position 71, a portion 88 of the pin 70 is located within the body 87 of the actuator 69 and is not in direct electrical contact with the body 87. An electrical contact 89 is intermediate the pin 70 and an actuating rod 90. The electrical contact 89 is also not in direct electrical contact with the electrically conducting body 87 while the pin 70 is in the retracted position 71. A coil 91 surrounds the actuating rod 90 and comprises a contact end 92 and a ground end 93. The contact end 92 is in electrical communication with the electrically conducting body 87 and the ground end 93 is in electric communication with the outer shield 68 of the coaxial cable 66. As shown in the FIG. 5, the ground end 93 of the coil 91 may be located further away from the end 45 of the second tubular component 40 (shown in FIG. 3) than the contact end 92; however, in other embodiments of the present invention the contact end 92 may be located further away from the end 45 of the second tubular component 40 than the ground end 93. The actuating rod 90 may be a magnetostrictive material, such as Terfenol D. Preferably the actuating rod 90 is a displaceable rod that actuates when a current is applied to the coil 91.

Since the coil 91 is grounded to the outer shield 68 a power signal which is applied to the inner core 67 of the coaxial cable 67 may travel through the inner core 67 to the electrically conducting body 87 and then through the coil 91 to the ground end 93. When the coil 91 is energized, the actuating rod 90 is displaced and moves the pin 70 into the contacting position 78. In another embodiment where the rod 90 is made of a magnetostrictive material, the rod 90 will expand. In both embodiments, it is believed that the electrical contact 89 will move as the pin 70 moves, such that the electrical contact 89 will make contact with the electrically conducting body 87 as the pin 70 makes direct electrical contact with the electrically conducting receptacle 73 in the end 45 of the second tubular component 40 as shown in FIG. 4.

It is further believed that once the pin 70 has made electrical contact with the electrically conducting receptacle 73, that a portion of the power signal will travel from the electrically conducting body 87 through the electrical contact 89 and pin 70 to the receptacle 73 and into the inner core 76 of the second tubular component 40 as shown in FIG. 4. It is believed that the majority of the power signal may travel to inner core 76 if there is enough resistance in the coil 91, but that enough of the power signal will still travel through the coil 91 to the ground end 93 to maintain the pin 70 in the contacting position 78. This may be advantageous as the actuator 69 may require less power to maintain the pin 70 in the contacting position 78 than to move the pin 70 into the contacting position 78. Thus, by making direct electrical connection 65 between the pin 70 and the receptacle 71, the power consumption state of the actuator 69 may change.

Figure 6:
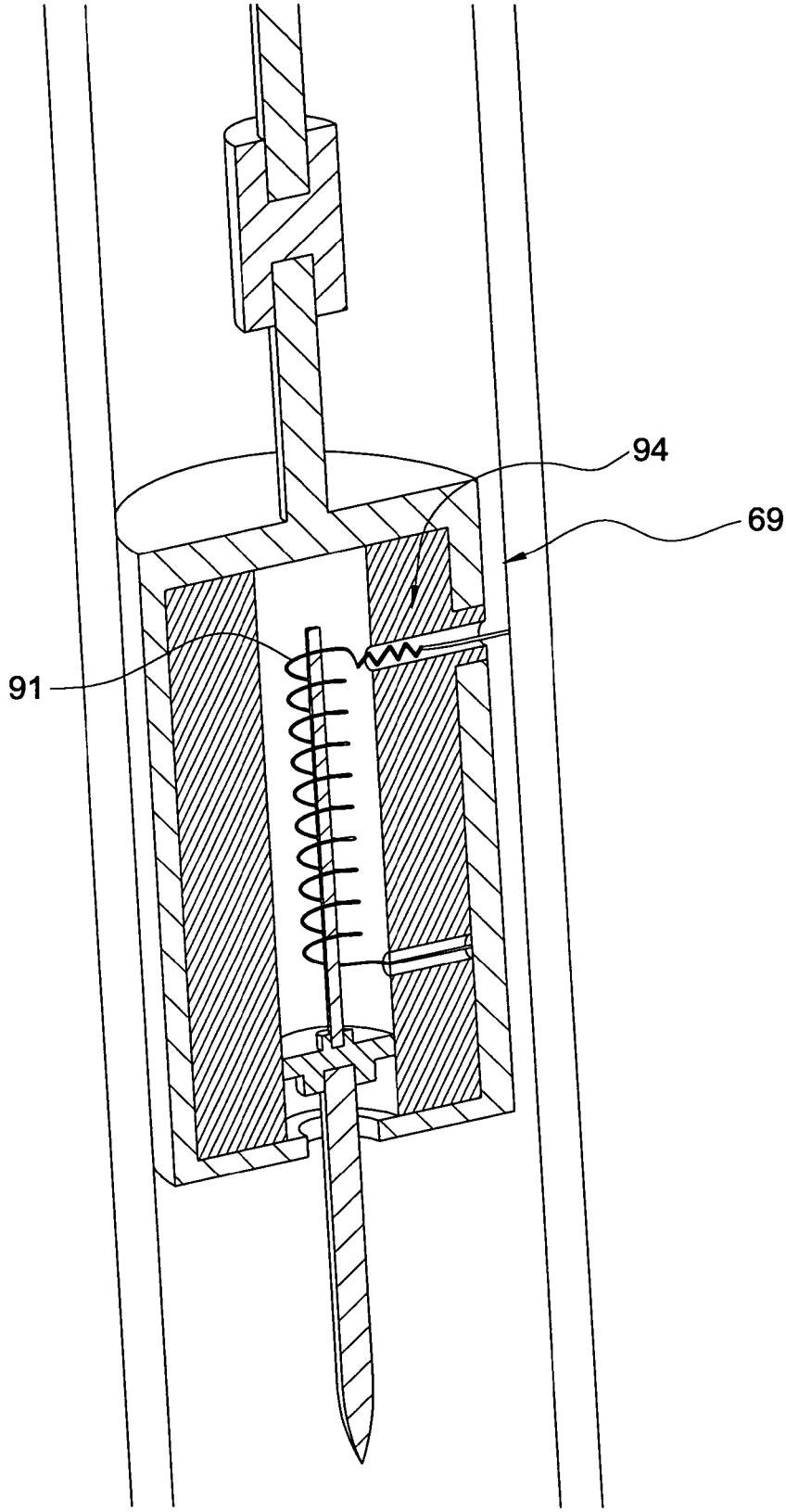
FIG. 6 is a cross sectional diagram of another embodiment of an actuator.

FIG. 6 is a cross sectional diagram of another embodiment of an actuator 69 showing a resistor 94 in the coil 91. Capacitors, stubs, or inductors may also be used to modify the electrical characteristics, such as resistance, of the coil 91. Further the length, thickness or material of the coil 91 may also be used to modify the electrical characteristics of the coil 91. The resistance of the second transmission path 44 may determine the amount of resistance that is needed in the coil 91 to encourage the majority of the power signal to travel to the second transmission path 44, while encouraging enough of the power signal to travel through the coil 91.

Figure 7:
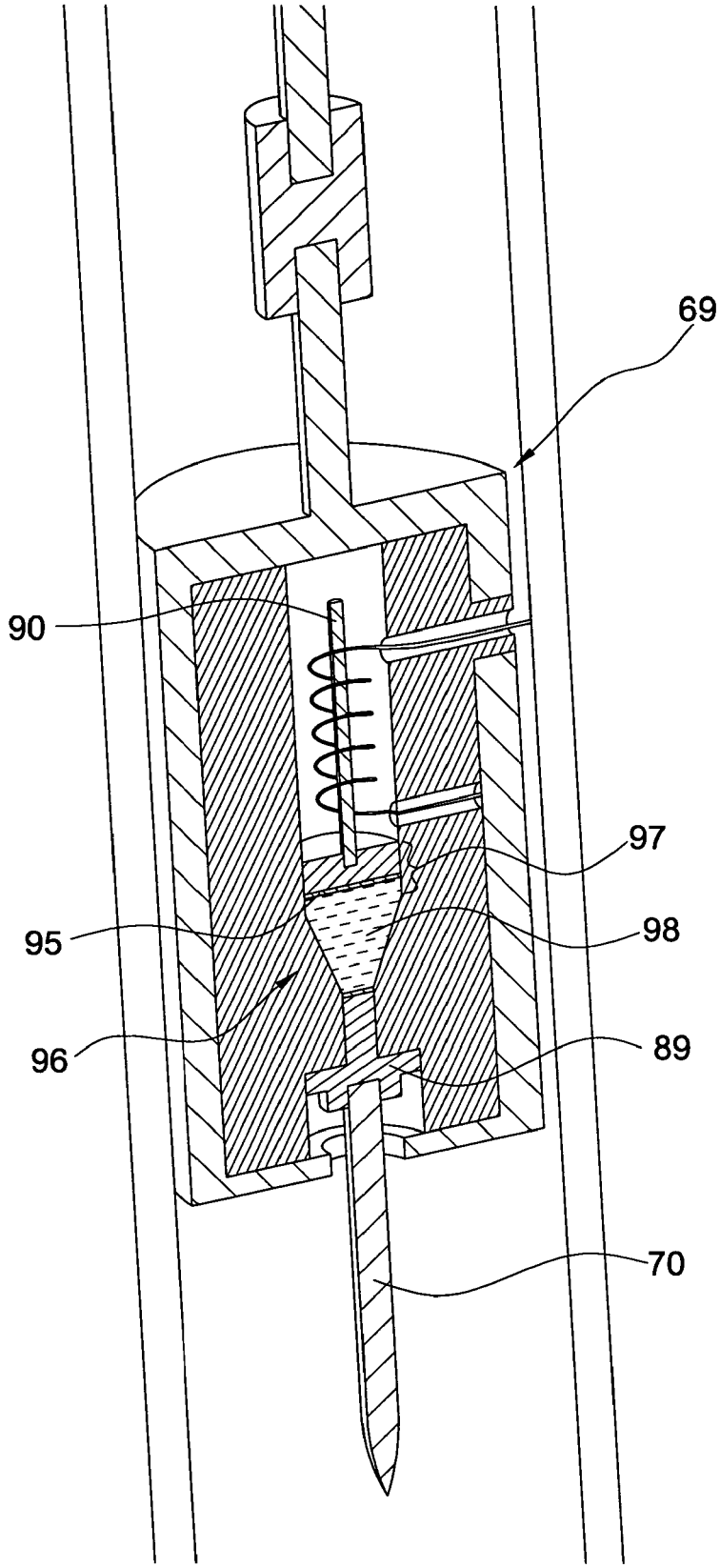
FIG. 7 is a cross sectional diagram of another embodiment of an actuator.

FIG. 7 is a cross sectional diagram of another embodiment of an actuator 69. A piston 95 in a funnel shaped chamber 96 is intermediate the actuating rod 90 and the electrical contact 89. As the actuating rod 90 moves, the piston 95 moves within a wider section 97 of the chamber 96 and allows for fluid displacement within the chamber 96. As the fluid 98 is displaced, the electrical contact 87 may move. This embodiment may be desirable such to allow the pin 70 to travel a greater distance than the actuating rod 90.

Figure 8:
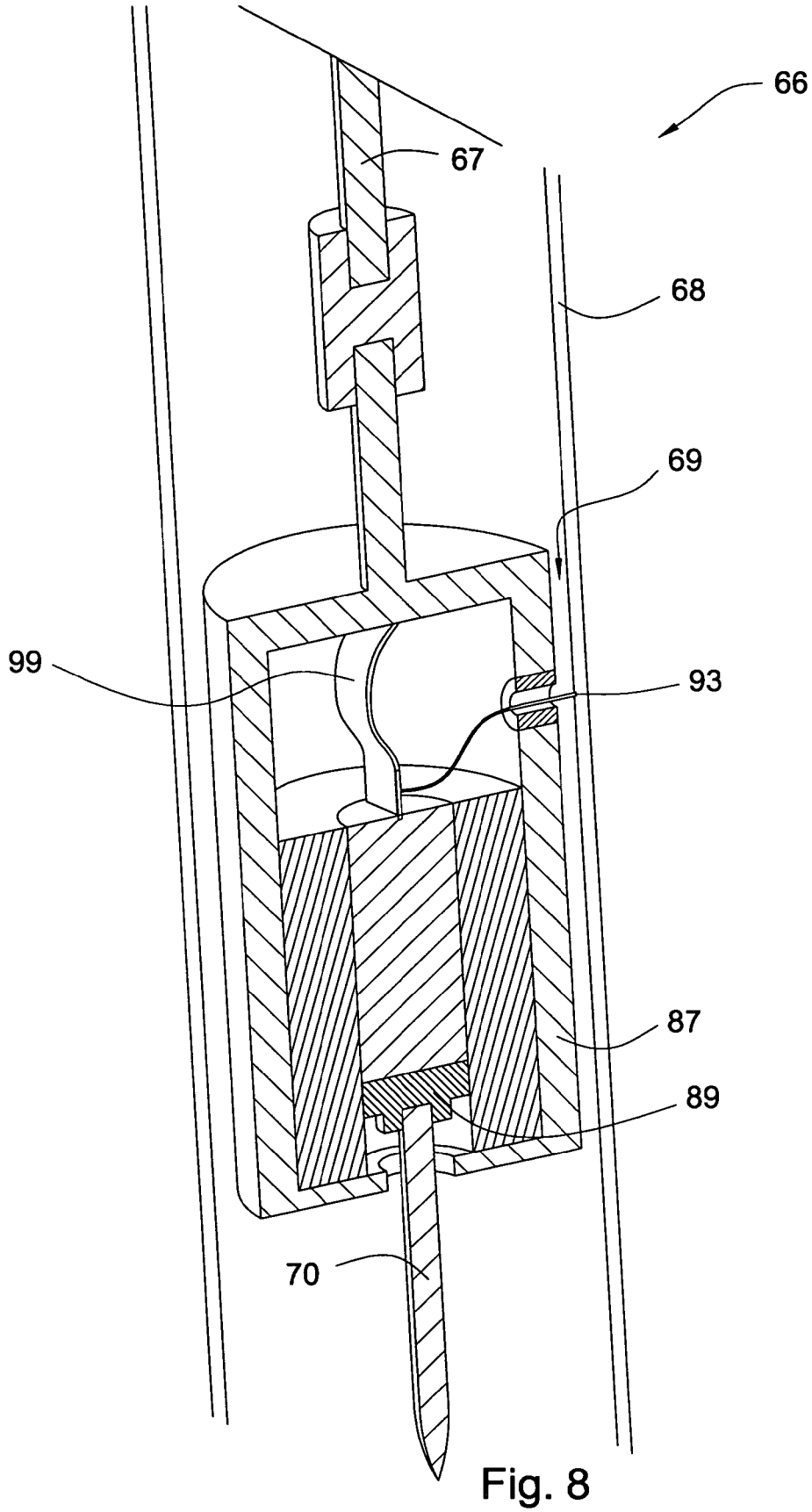
FIG. 8 is a cross sectional diagram of an actuator comprising a piezoelectric material.

FIG. 8 is a cross sectional diagram of an actuator 69 comprising a piezoelectric material 99. The piezoelectric material 99 may include zirconate titanate or BaTiO(3). The piezoelectric material 99 may comprise a non-linear shape, such that when a power signal travels through the piezoelectric material 99 the non-linear shape will straighten and displace the electrical contact 89 over a greater distance than if the piezoelectric material 99 were in a completely linear shape. The non-linear shape may be a curved shaped or a zigzag shape. In some embodiments of the present invention, a linear shaped piezoelectric material may be used. As with FIGS. 5-7, it is believed that initially a power signal may travel from the inner core 67 of the coaxial cable 66 through a path to a ground end 93 on the outer shield 68 of the coaxial cable 66. In the embodiment shown in FIG. 7, the power signal travels through the piezoelectric material 99 to ground. It is also believed that once the piezoelectric material 99 is energized by the power signal, the electrical contact 89 will make contact with the electrically conducting body 87 as the pin 70 makes contact with the electrically conducting receptacle 73 (shown in FIG. 4). When the direct electrical connection 65 between the pin 70 and the electrically conducting receptacle 73 is formed, it is believed that a portion of the power signal will travel through to the inner core 76 of the second tubular component 40 while enough of the power signal will still travel through the piezoelectric material 99 to ground and maintain the pin 70 in the contacting position 78 (also shown in FIG. 4). A hydraulic chamber and a piston similar to the embodiment shown in FIG. 7 may be utilized with a piezoelectric material 99 as well.

Figure 9:
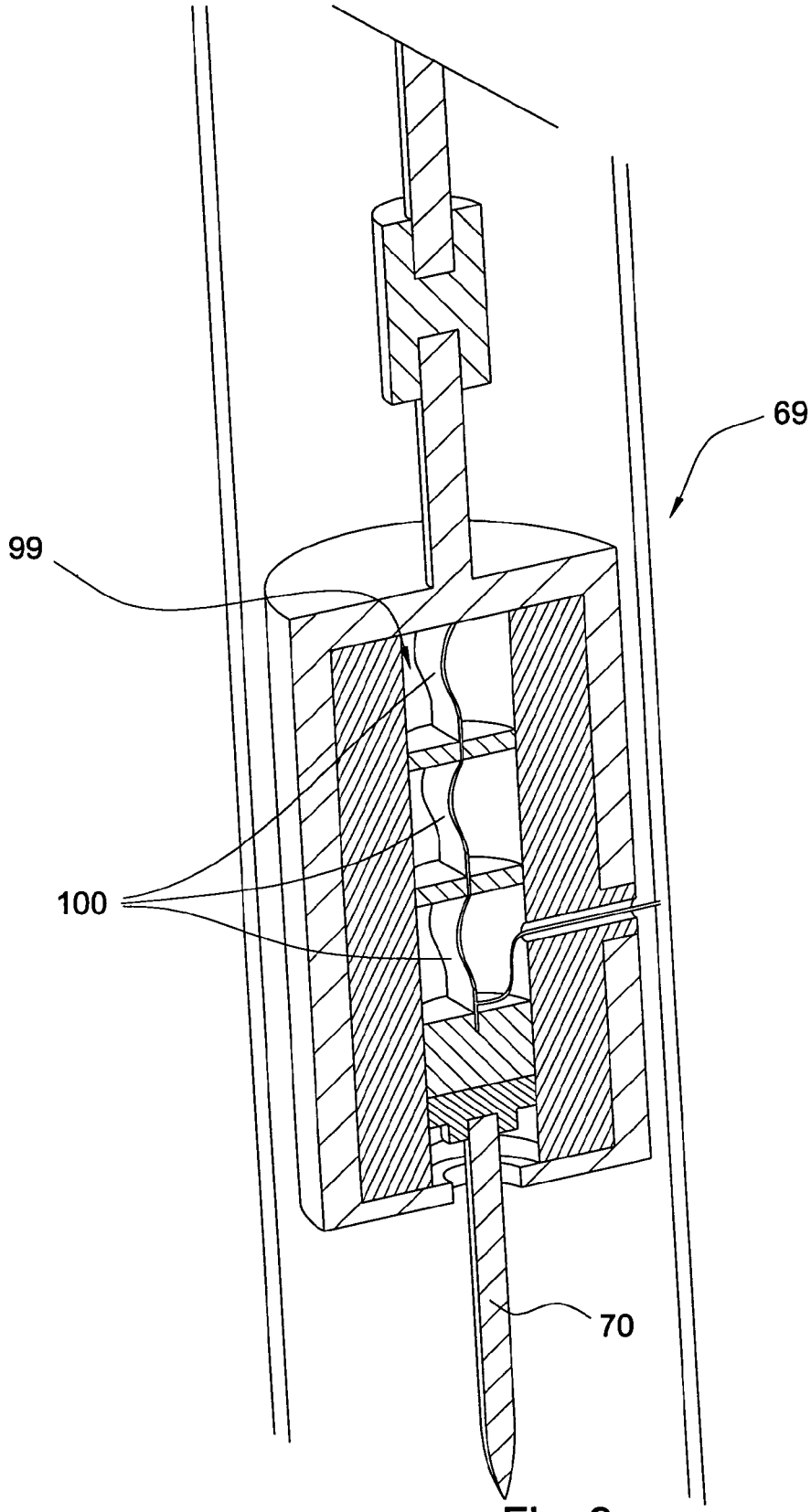
FIG. 9 is a cross sectional diagram of another embodiment of an actuator comprising a piezoelectric material.

Further, FIG. 9 is a cross sectional diagram of another embodiment of an actuator 69 comprising a piezoelectric material 99, where multiple piezoelectric segments 100 are utilized. It may be advantageous to have multiple piezoelectric segments 100 to increase the distance that the pin 70 may travel.

Figure 10:
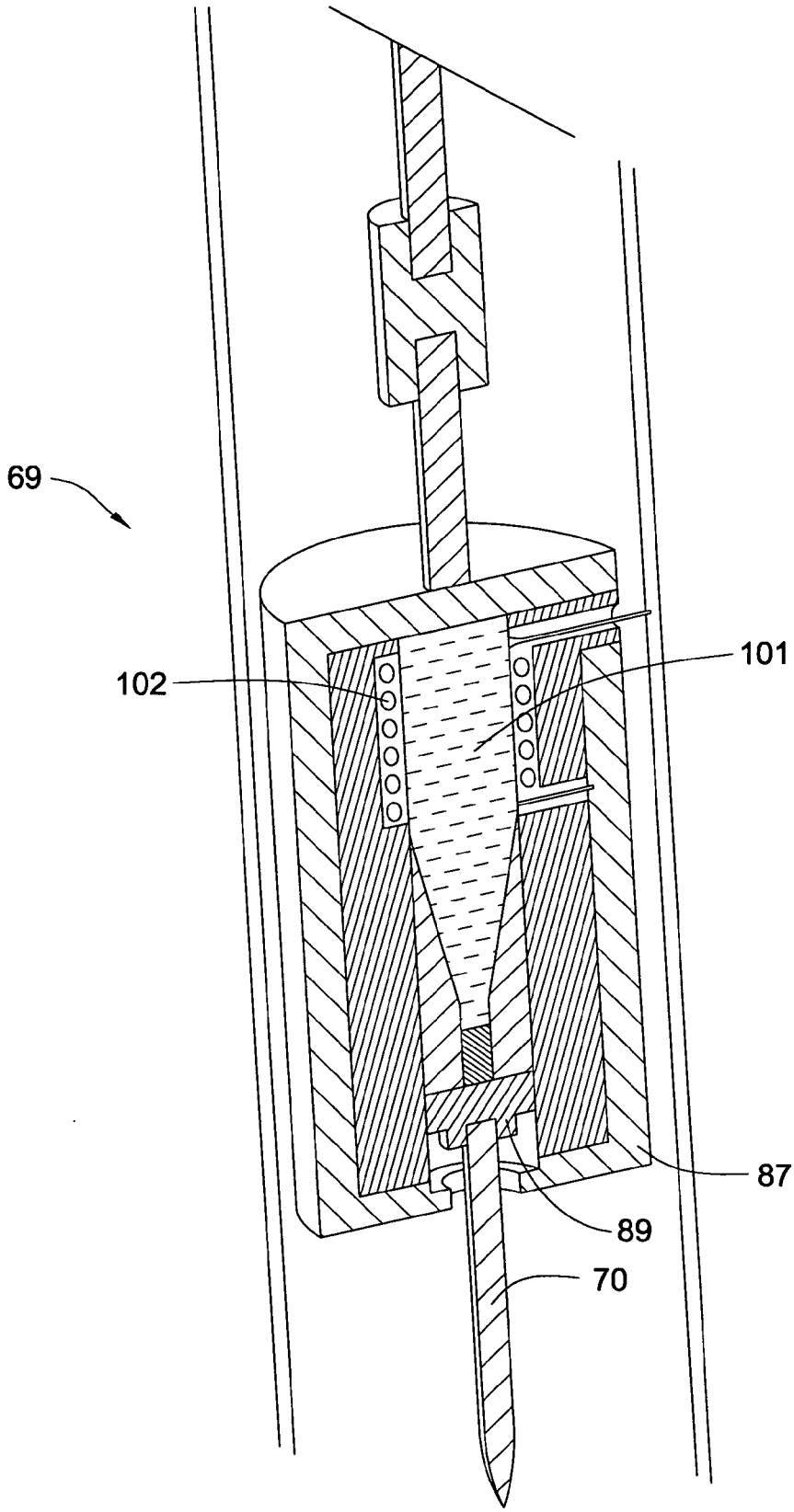
FIG. 10 is a cross sectional diagram of an actuator comprising an electrically controllable fluid.

FIG. 10 is a cross sectional diagram of an actuator 69 comprising an electrically controllable fluid 101. The electrically controllable fluid 101 may be a magnetorheological fluid which may be purchased from the Lord Corporation centered in Cary, N.C. The magnetorheological fluid may be water, silicon, or hydrocarbon based. A coil 102 similar to the coil 91 disclosed in FIG. 5 is shown. It is believed that as a power signal travels through the coil 102, the electrically controllable fluid 101 will expand and cause the electrical contact 89 to make contact with the electrically conducting body 87, which will allow a portion of the power signal to travel through the pin 70 to the inner core 76 of the second tubular component 40 as shown in FIG. 4. In other embodiments of the present invention, an electrorheological fluid may be used.

Figure 11:
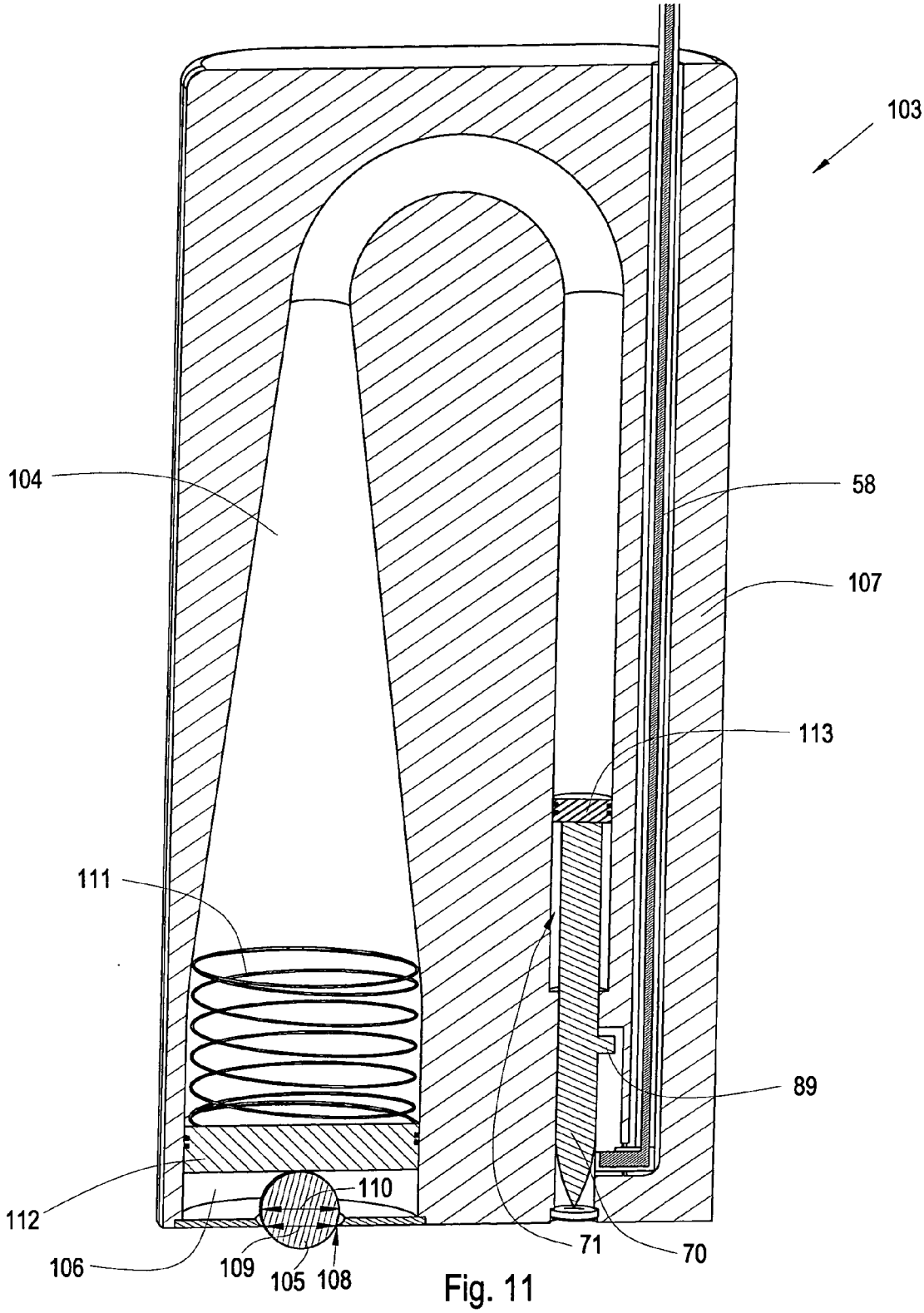
FIG. 11 is a cross sectional diagram of a mechanical actuator.
Figure 12:
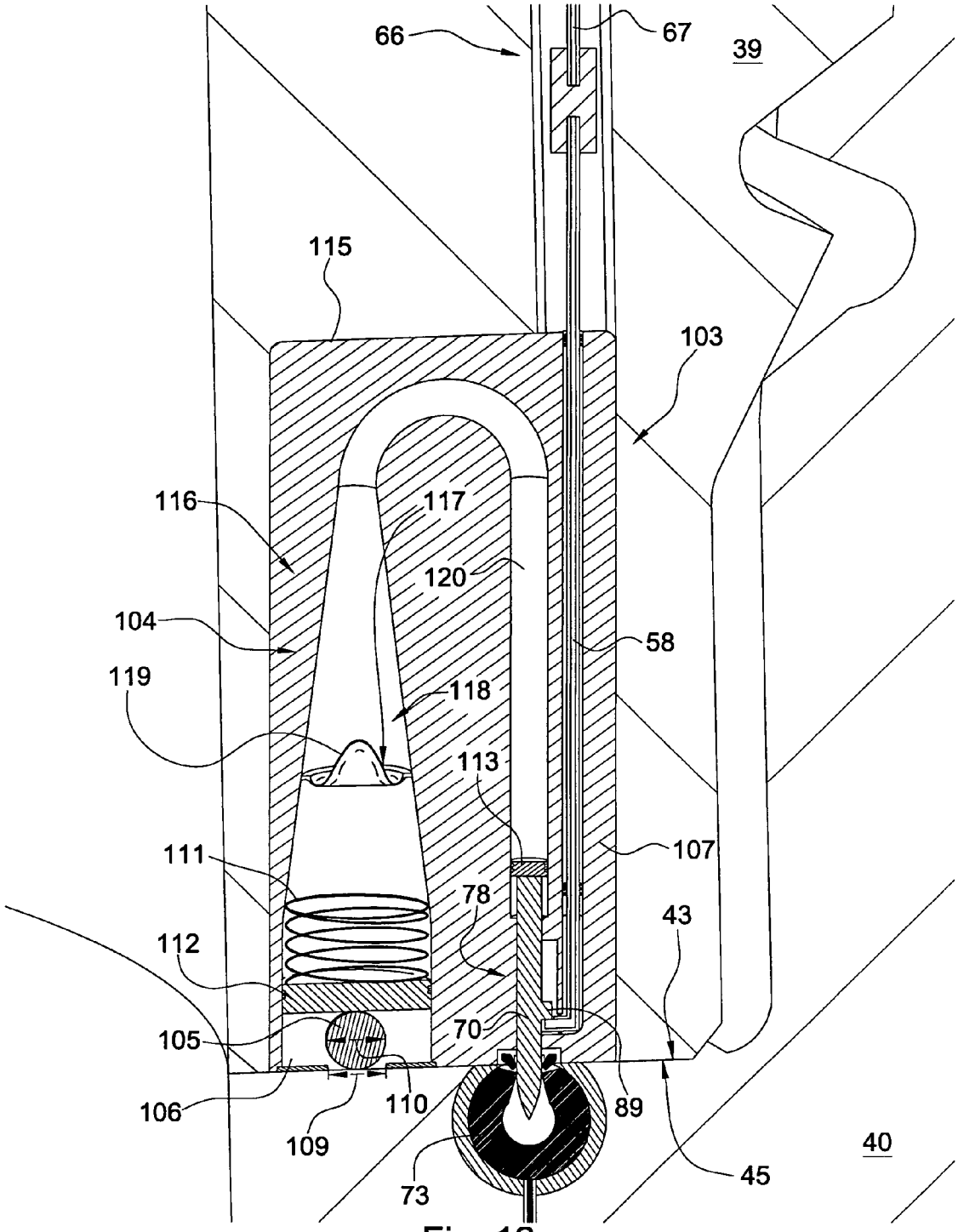
FIG. 12 is a cross sectional diagram of another embodiment of a direct electrical connection.

FIGS. 11 and 12 are cross sectional diagrams of a mechanical actuator 103. A hydraulic chamber 104 is intermediate the pin 70 and a bearing 105. The bearing 105 is disposed within a cavity 106 of an insert 107 which includes the replaceable portion 58 of the first transmission path 41. The cavity 106 comprises an aperture 108 with a diameter 109 smaller than the diameter 110 of the bearing 105. This allows the bearing 105 to be retained within the cavity 106. A spring 111 biases a bearing piston 112 against the bearing 105 so that the bearing 105 protrudes out of the end 43 of the first tubular component 39. The bearing 105 may be a roller or ball bearing. It may be desirable for the bearing 105 to be made of durable material to prevent the bearing 105 from deforming under impacts, such as when the ends 43, 45 of the components 39, 40 are coming together. A durable material may comprise steel, diamond, silicon nitride, or other ceramics. The bearing 105 comes into contact with the end 45 of the second tubular component 40 when the first and second components 39, 40 are torqued together. As the ends 43, 45 of the components 39, 40 come together, the end 45 of the second component 40 may push the bearing 105 into the cavity 106 displacing the bearing piston 112. Fluid displacement caused by the movement of the bearing piston 112 will cause a pin piston 113 to move, which will cause the pin 70 to move from a retracted position 71 to a contacting position 78 as shown in FIG. 12. As the pin 70 makes contact with the receptacle 73 in the second component 40 an electrical contact 89 on the pin 70 will contact the replaceable portion 58 of the first transmission path 41.

It may be desirable to have the hydraulic chamber 104 wider near the bearing piston 112 than near the pin piston 113 such that the pin 70 may travel a greater distance than the bearing 105. A mechanical actuator 103 may be desirable since it does not require power to maintain the pin 70 in the contacting position 78. The insert 107 may be disposed within a recess 115 formed in either a box end or a pin end of the tubular components 39, 40.

The hydraulic chamber 104 may comprise a delay mechanism 116, such as a semi-rigid spring seal 117. As the pressure in a first portion 118 of the hydraulic chamber 104 builds pressure due to movement of the bearing piston 112, a force from the pressure pushes against a convex sheet 119 of the seal 117. When the pressure reaches a threshold, the convex sheet 119 will give into the pressure and bow inward transitioning to a concave sheet. The transition increases the pressure within a second portion 120 of the hydraulic chamber 104, which pressure displaces the pin piston 113. A delay mechanism 116 may be desirable so that the pin exists the passage after the ends of the tubular components have all ready been torqued together.

Figure 13:
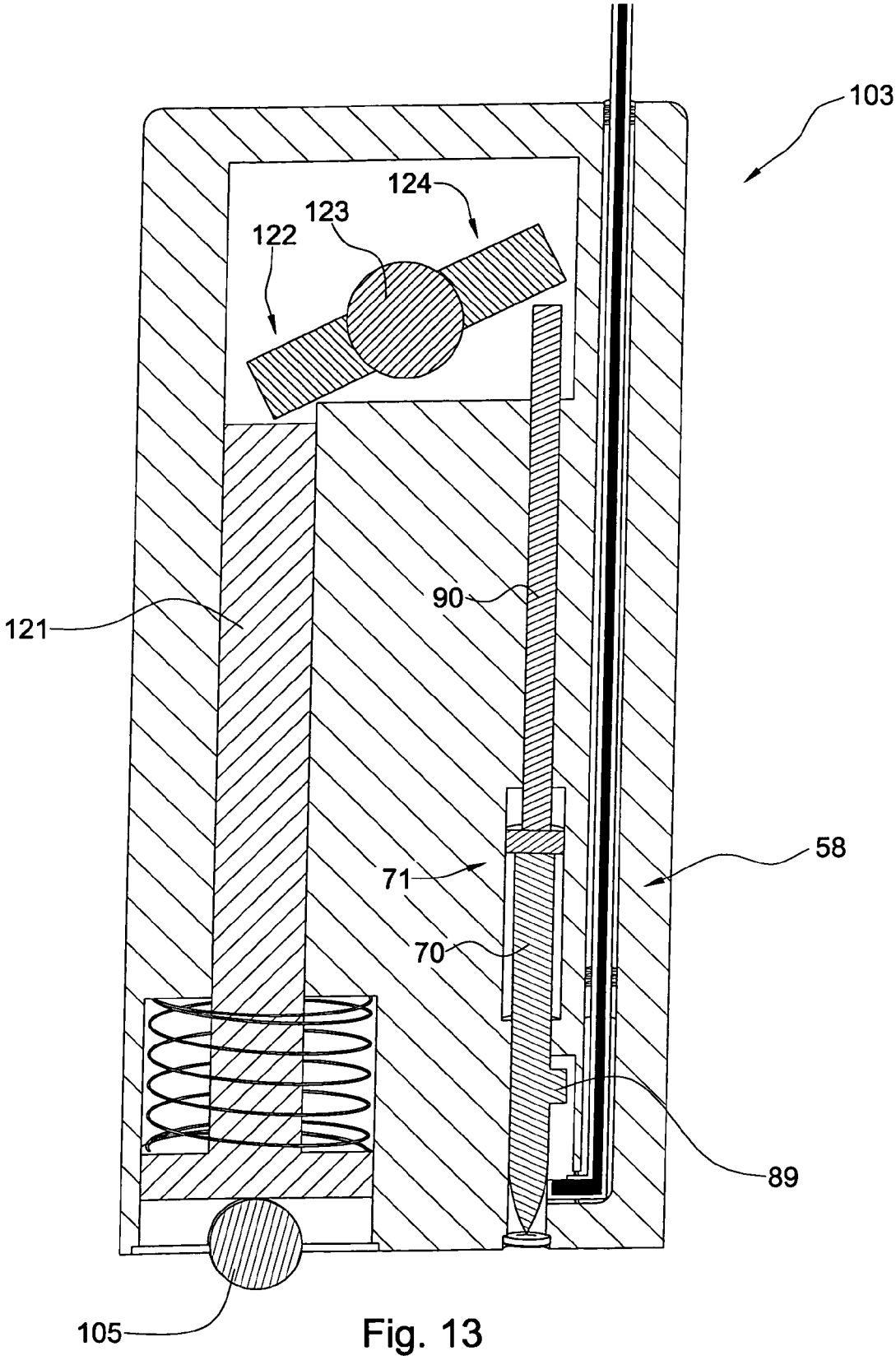
FIG. 13 is a cross sectional diagram of another embodiment of a mechanical actuator.

FIG. 13 is a cross sectional diagram of another embodiment of a mechanical actuator 103. In this embodiment the bearing 105 pushes a spring-loaded rod 121 up which pushes against a first side 122 of a pivot 123. The second side 124 of the pivot 123 pushes down on the actuating rod 90. As the actuating rod 90 travels down, the pin 70 moves from the retracted position 71 to the contacting position 78. As the pin 70 moves into the contacting position 78, the electrical contact 89 makes contact with the first transmission path 41. The actuating rod 90 may also be spring loaded (not shown) to encourage the actuating rod 90 to retract when the ends 43, 45 of the components 39, 40 are disengaged.

Figure 14:
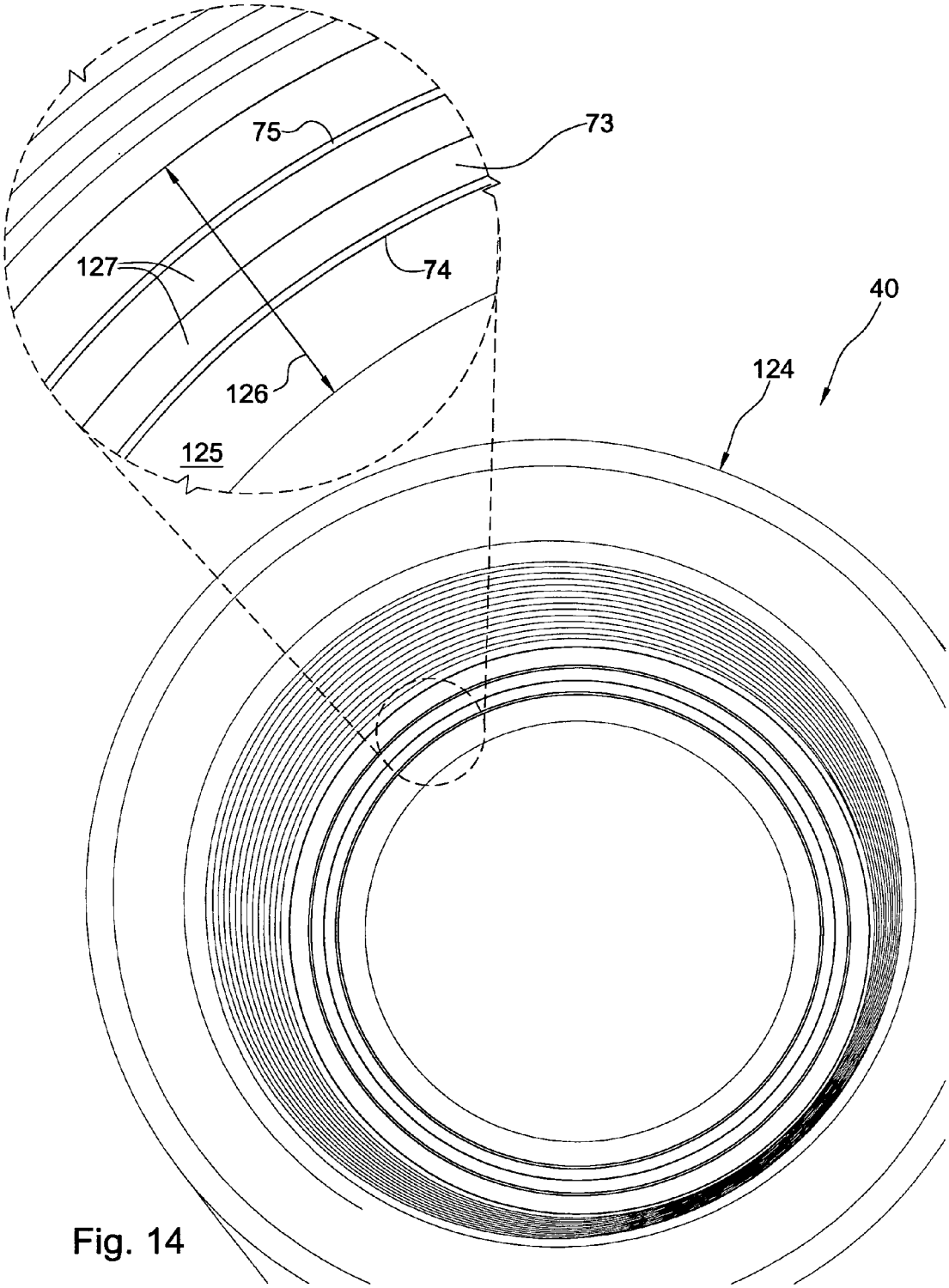
FIG. 14 is a perspective diagram of an electrically conducting receptacle.
Figure 15:
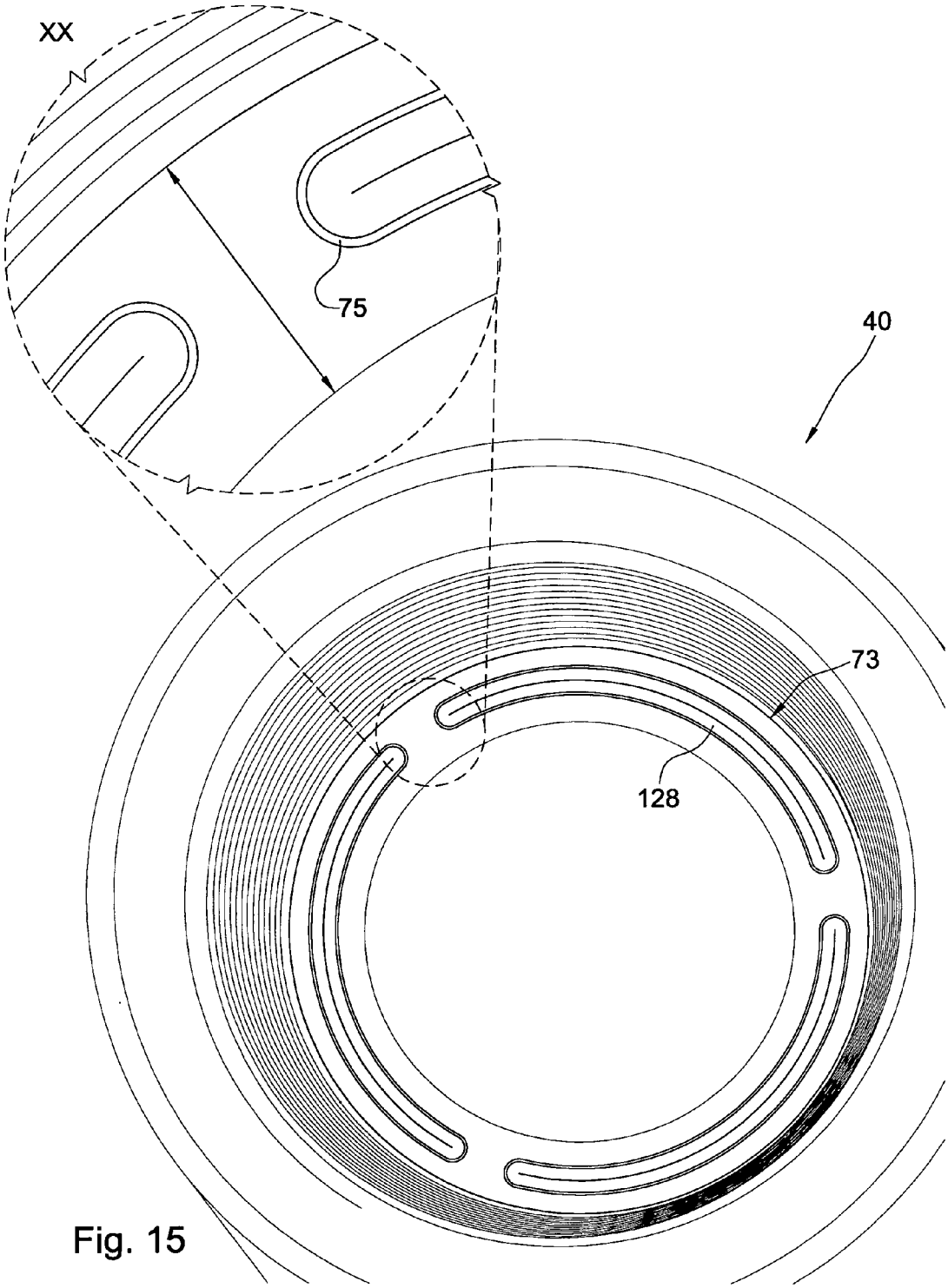
FIG. 15 is a perspective diagram of another embodiment of an electrically conducting receptacle.

FIG. 14 is a perspective diagram of an electrically conducting receptacle 73. The electrically conducting receptacle 73 is located in the box end 124 of the second tubular component 40. In some embodiments, such as those embodiments comprising mechanical actuators 103, the electrically conducting receptacle 73 may be located in the pin end of the tubular components 39, 40. As shown in FIG. 14, the receptacle 73 is disposed within a groove 74 formed in the secondary shoulder face 125 of a tubular component. The width 126 of the shoulder face 125 is depicted by the arrow. Also shown are wipers 127 that the pin 70 travels past as the pin 70 moves into the contacting position 78. The receptacle 73 may be an annular receptacle so that the pin 70 may make contact with the receptacle 73 regardless of the pin's location along the end 43 of the first tubular component 39. The receptacle 73 may also be a segmented annular receptacle, such that the segments 128 are electrically isolated from each other, as shown in FIG. 15. It may be desirable to have a segmented annular receptacle or other variations of multiple receptacles so that multiple transmission paths may be utilized in the tubular components 39, 40. An elastomeric lining 75, is also shown, which electrically insulates the receptacle from the second tubular component 40.

Figure 16:
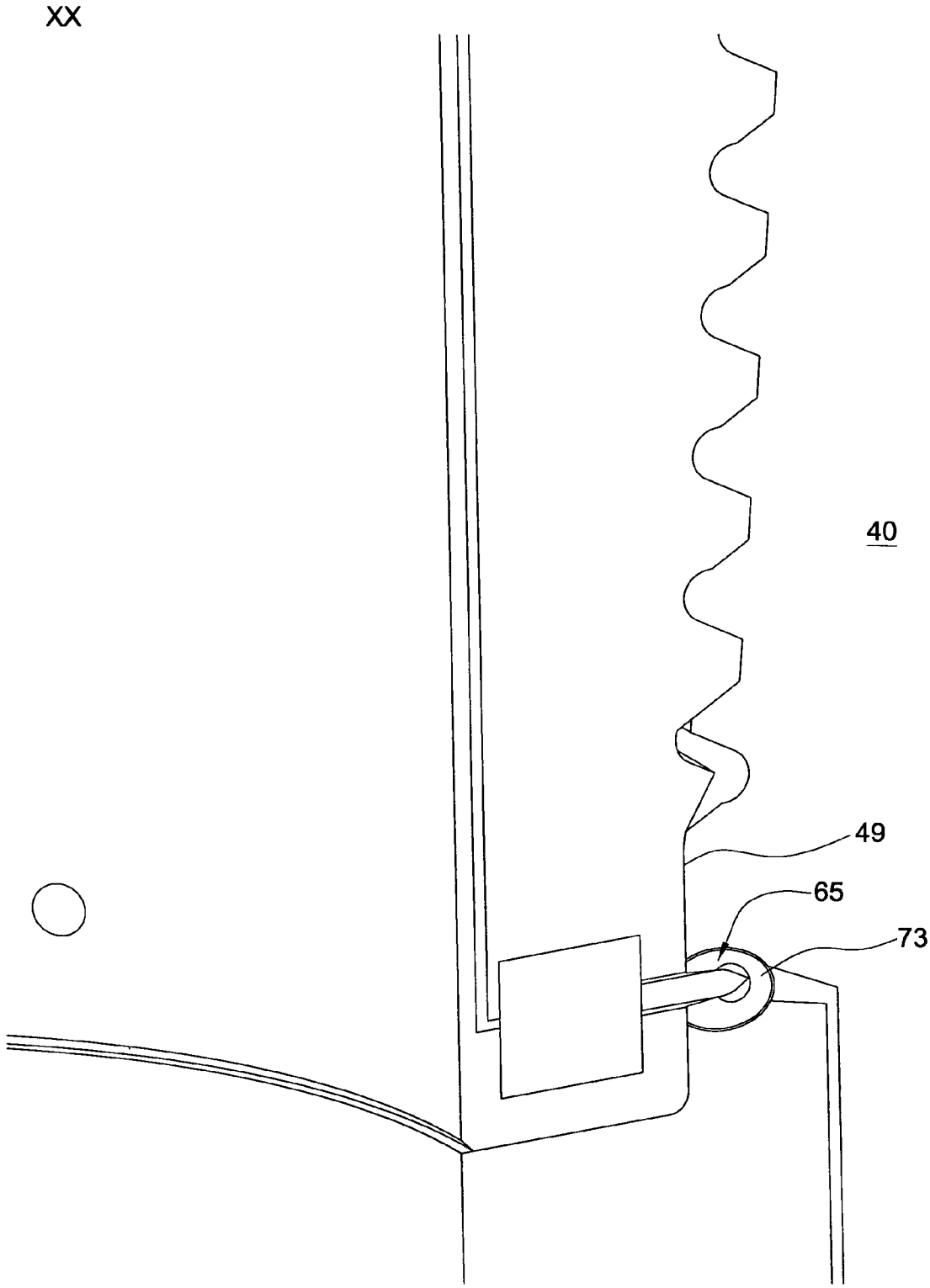
FIG. 16 is a perspective diagram of another embodiment of a direct electrical connection.

FIG. 16 is a perspective diagram of another embodiment of a direct electrical connection 65, such that the receptacle 73 is located in the internal wall 49 of the second tubular component 40.

Figure 17:
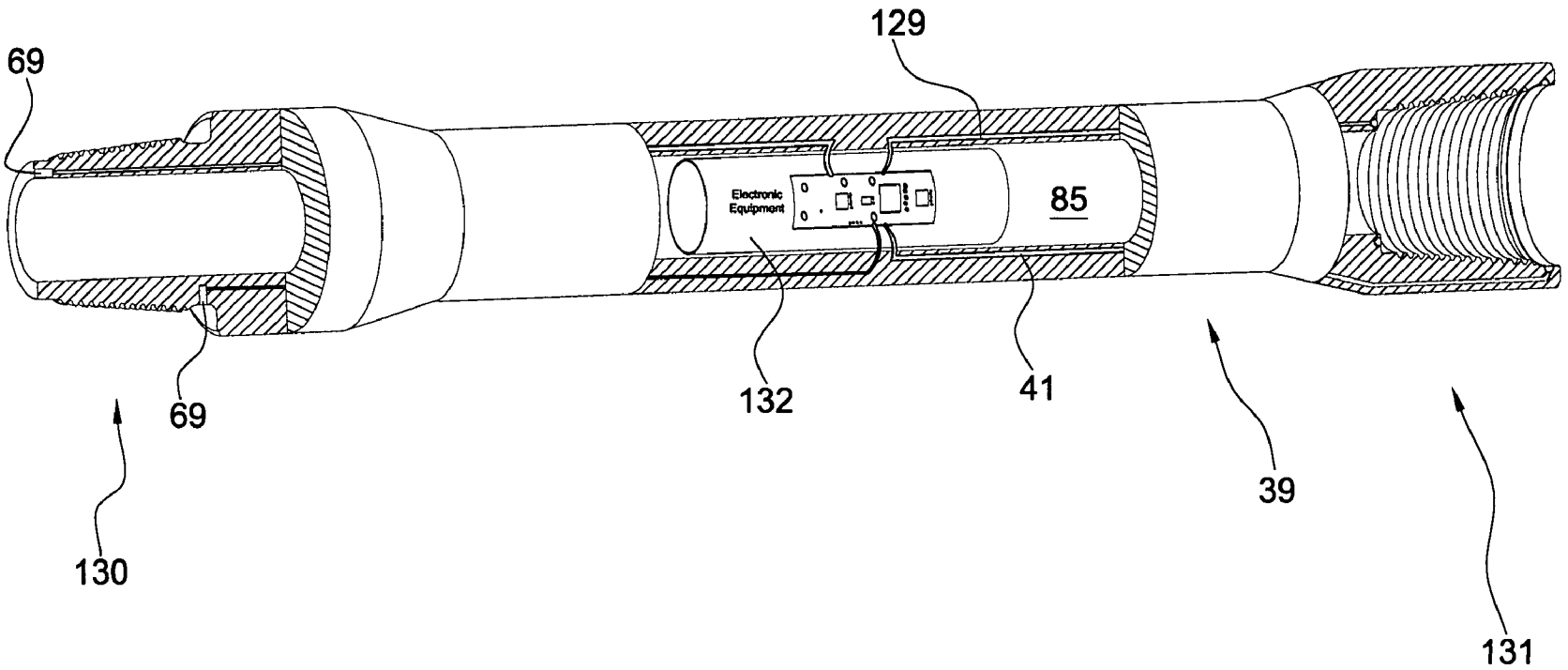
FIG. 17 is a perspective diagram of additional transmission paths.

FIG. 17 is a perspective diagram of an additional transmission path 129. The component 39 may comprise the actuators 69 in a pin end 130 and the receptacles 73 in the box end 131. The receptacle 73 may be a segmented annular receptacle 73 as shown in FIG. 15. Further electronic equipment 132 may be located with the bore 85 of the tubular component 39. The electronic equipment 85 may comprise a switch so that power, data, network packets, or combinations thereof may be transferred from the transmission path 41 to the additional transmission path 129.

The electronic equipment 85 may also include signal filtering circuitry, signal error checking circuitry, device control circuitry, modems, digital processors, optical regenerators, optical transmitters, optical receivers, repeater circuitry, sensors, routers, memory, amplifiers, data compression circuitry, data rate adjustment circuitry, piezoelectric devices, lights, gauges, wireless transceivers, digital/optical converters, analogue/optical converters, power sources, and microcontrollers.

Figure 18:
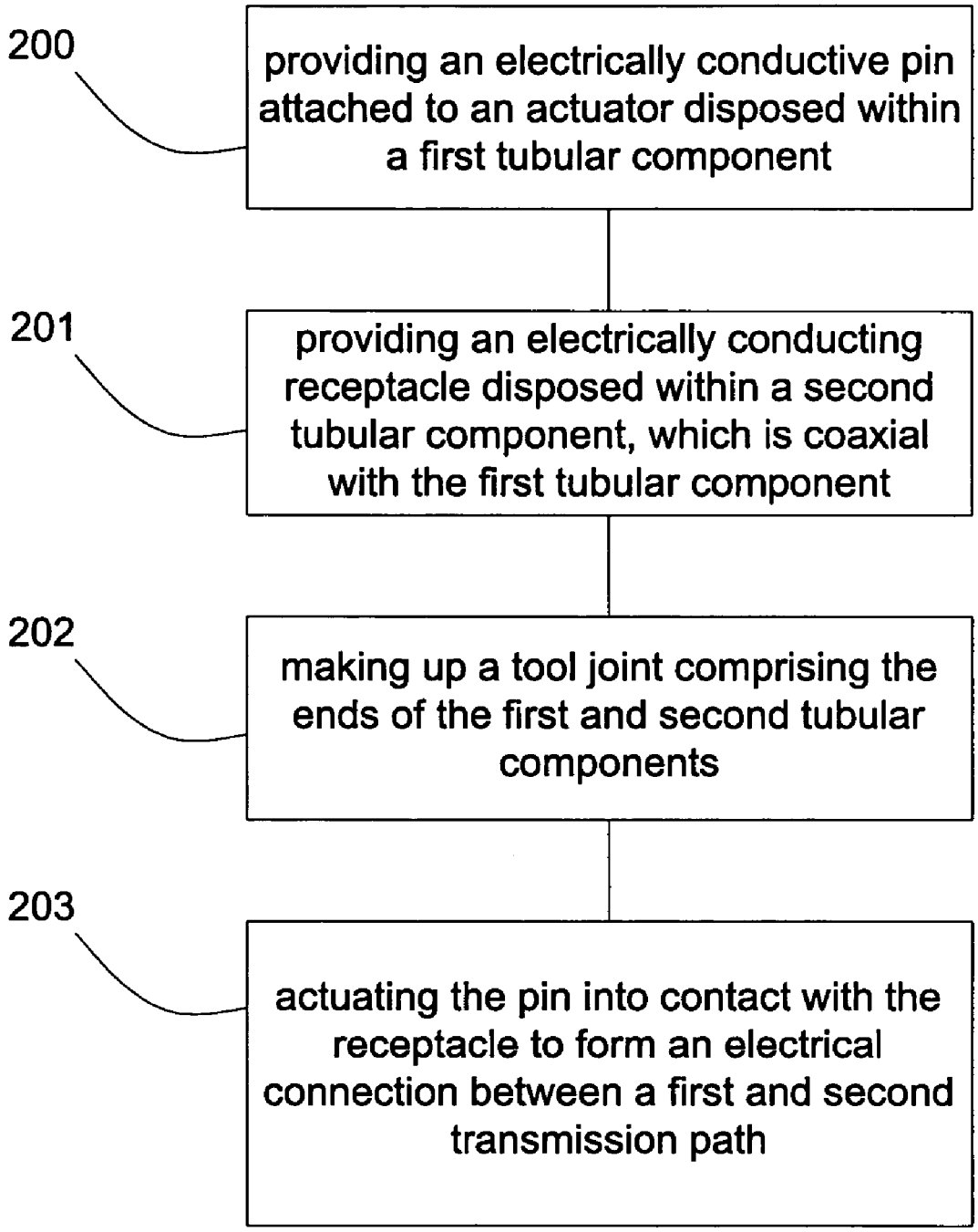
FIG. 18 is a diagram of a method for forming an electrical connection between a first and second transmission path.

FIG. 18 is a diagram of a method for forming an electrical connection between a first and second transmission path. The method comprises the step 200 of providing an electrically conductive pin attached to an actuator disposed within a first tubular component and the step 201 of providing an electrically conducting receptacle disposed within a second tubular component, which is coaxial with the first coaxial component. A further step 202 includes making up a joint comprising the ends of the first and second tubular components. Further, the method includes a step 203 of actuating the pin into contact with the receptacle to form an electrical connection between the first and second transmission path. Step 203 may be performed by mechanical, hydraulic, magnetic, or electric means. If the actuator is a solenoid, then an electric current may be applied to the first transmission path and activate the pin to form an electrical connection. Further the electric current may path through the receptacle to the second transmission path and activate another solenoid to form another electrical connection with another tubular component. The electrical current may sequentially activate a plurality of solenoids along a downhole tools string, such that power, data, and/or packets may be transmitted along the length of the of the tool string.

Whereas the present invention has been described in particular relation to the drawings attached hereto, it should be understood that other and further modifications apart from those shown or suggested herein, may be made within the scope and spirit of the present invention.

What is claimed is:

1. An electrical connection in a downhole tool string, comprising a downhole tool string tubular component comprising a sidewall comprising a threaded box end further comprising a secondary shoulder and comprising a threaded pin end further comprising a secondary shoulder;

a first passageway in the sidewall of the component which opens into a face of the pin end secondary shoulder and a second passageway in the sidewall of the component which opens into an annular groove in a face of the box end secondary shoulder;

an actuated electrically conductive pin being communication with an actuator and being disposed within the first passageway adjacent the secondary shoulder of the pin end;

and an electrically conductive groove disposed along the annular receptacle;

the pin and receptacle being electrically connected by a wire running through the respective passageways;

wherein, when the tubular component is threadedly connected to a similarly configured component in the tool string, and the first passageway and the annular groove are proximate one another, and the actuator is energized, the pin is inserted into the receptacle to form an electrical connection between the connected tubular components.

2. The connection of claim 1, wherein the actuated pin comprises a solenoid.

3. The connection of claim 1, wherein the actuated pin comprises a piezoelectric material, a magnetostrictive material, a piston, a fluid, an electrically controllable fluid, a gear, a pivot, a bearing, a spring or combinations thereof.

4. The connection of claim 1, wherein the actuated pin comprises multiple power consumption states.

5. The connection of claim 4, wherein the first passageway comprises a wiper.

6. The connection of claim 1 wherein the electrically conductive receptacle is an annular receptacle.

7. The connection of claim 3, wherein the annular receptacle is segmented.

8. The connection of claim 6, wherein sides of the receptacle are biased inward.

9. The connection of claim 1, wherein the receptacle comprises a wiper.

10. The connection of claim 1, wherein the receptacle is biased towards the pin.

11. The connection of claim 1, wherein the wire comprises a coaxial cable, a pair of twisted wires, a triaxial cable, a twinaxial cable, copper wires, or combinations thereof.

12. The connection of claim 1, wherein the tubular component comprises additional electrical connections.

13. The connection of claim 1, wherein the wire provides electrical energy to the actuator.

14. The connection of claim 1, wherein the electrical connection relays power, data, network packets, or combinations thereof between surface equipment and downhole tools.

15. The connection of claim 1, wherein the tubular components are selected from the group consisting of production pipe, drill pipe, drill collars, motors, reamers, subs, swivels, jars, hammers, and bottomhole assemblies.

* * * * *